US010993885B1

(12) United States Patent
Fernandez

(10) Patent No.: US 10,993,885 B1
(45) Date of Patent: May 4, 2021

(54) BABY BOTTLE HOLDER

(71) Applicant: Katherine Fernandez, Pompano Beach, FL (US)

(72) Inventor: Katherine Fernandez, Pompano Beach, FL (US)

( * ) Notice: Subject to any disclaimer, the term of this patent is extended or adjusted under 35 U.S.C. 154(b) by 0 days.

(21) Appl. No.: 17/001,278

(22) Filed: Aug. 24, 2020

(51) Int. Cl.
*A47D 15/00* (2006.01)
*A61J 9/06* (2006.01)

(52) U.S. Cl.
CPC ..... *A61J 9/06* (2013.01); *A61J 9/0661* (2015.05)

(58) Field of Classification Search
CPC ..... A61J 9/06; A45F 3/14; A45F 2200/0583; A45C 3/14
See application file for complete search history.

(56) References Cited

U.S. PATENT DOCUMENTS 4,982,885 A * 1/1991 Severson ..... A45C 13/30 224/250
5,135,189 A 8/1992 Ghazizadeh
5,699,555 A * 12/1997 Schunter ..... A47D 13/086 119/770
6,386,490 B1 5/2002 Suh
6,598,837 B1 7/2003 Howard et al.
6,598,838 B2 7/2003 Suh
D512,910 S * 12/2005 Haslam ..... D9/434
6,971,612 B1 12/2005 Wilson-Lowery
D625,425 S * 10/2010 Williams ..... D24/199
D662,006 S * 6/2012 Lilak ..... A44C 15/005 D11/87
D699,405 S * 2/2014 McKinnell ..... D30/153
D732,675 S * 6/2015 Granillo ..... A47D 13/086 D24/194
2003/0121944 A1 7/2003 Scanlan et al.
2004/0007017 A1* 1/2004 Flaherty ..... A44C 15/005 63/3.1
2008/0282515 A1 11/2008 Crevin

OTHER PUBLICATIONS

"Sippigrip Silicone, Now at Walmart!", Nov. 7, 2019, 4 pages, Retrieved from: https://booginhead.com/blogs/news/sippigrip-silicone-now-at-walmart.

* cited by examiner

*Primary Examiner* — Amy J. Sterling
(74) *Attorney, Agent, or Firm* — Talem IP Law, LLP

(57) ABSTRACT

A bottle holder includes an anchor arm a grip loop, and a rigid member. The anchor arm includes a plurality of bends and a plurality of segments. A segment is a portion of the anchor arm between two adjacent bends of the plurality of bends. At least two segments of the plurality of segments of the anchor arm each include a snap aperture. The grip loop forms a bottle aperture for holding a bottle disposed at a proximal end of the anchor arm. The rigid member is disposed at a distal end of the anchor arm. Each snap aperture of the at least two segments of the plurality of segments of the anchor arm are configured to receive the rigid member. In some cases, the grip loop, the anchor arm, and the rigid member are made of a single piece of elastic silicon material.

13 Claims, 6 Drawing Sheets

BABY BOTTLE HOLDER

BACKGROUND

Often, babies and young children will drop their bottle or other drink container. As a result, many bottles are lost, damaged, and/or soiled. Current baby bottle holders do exist that hold the bottle and attach the bottle to a supporting structure in order to prevent spillage of bottle's contents or to prevent the bottle from being lost. However, a common problem with pre-existing baby bottle holders is that the attachment holding the bottle may not have a strong enough grip on the bottle, and consequently the bottle may slip out from the attachment. Another problem is that the length of material tethering the bottle to the supporting structure may be too long, resulting in the bottle falling to the floor, despite being held by the baby bottle holder. Ideally, the baby bottle holder should also be made of a lightweight, child-safe material for practical use. Therefore, there exists a need for a safe, lightweight baby bottle holder that is able to maintain a strong grip on the baby bottle and prevent the bottle from falling to the floor and/or being lost.

BRIEF SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A bottle holder that includes a grip loop, an anchor arm, and a rigid member is described. The bottle holder is designed to hold a bottle (e.g., a baby bottle) via a flexible grip loop that stretches and tightens around the bottle to maintain secure attachment. The bottle holder is also designed to be tethered to a support structure to prevent misplacement of the bottle (e.g., dropping and/or losing the bottle) by positioning at least a portion of the anchor arm around a support object and inserting the rigid member through a snap aperture in the anchor arm. Advantageously, because the entire bottle holder is made of the same material that has certain elastic properties (e.g., elastic silicone), the bottle holder prevents a bottle full of liquid from dragging on the floor due to too much slack in the anchor arm, yet is still capable of stretching to allow freedom of movement with the bottle when a sufficient pulling force (e.g., a force greater than the weight of a full bottle of liquid) is applied.

A bottle holder includes an anchor arm a grip loop, and a rigid member. The anchor arm includes a plurality of bends and a plurality of segments. A segment is a portion of the anchor arm between two adjacent bends of the plurality of bends. At least two segments of the plurality of segments of the anchor arm each include a snap aperture. The grip loop forms a bottle aperture for holding a bottle disposed at a proximal end of the anchor arm. The rigid member is disposed at a distal end of the anchor arm. Each snap aperture of the at least two segments of the plurality of segments of the anchor arm are configured to receive the rigid member. In some cases, the grip loop, the anchor arm, and the rigid member are made of a single piece of elastic silicon material.

A method of using the bottle holder includes inserting the bottle into the grip loop, positioning the rigid member and at least a portion of the anchor arm around a support object, and inserting the rigid member through one snap aperture of the at least two segments of the plurality of segments of the anchor arm.

BRIEF DESCRIPTION OF THE DRAWINGS

The foregoing aspects and other features of the disclosure are explained in the following description, taken in connection with the accompanying drawings herein.

DETAILED DISCLOSURE

Figures 1A, 1B, 1C, 1D, 1E, 1F, 1G:
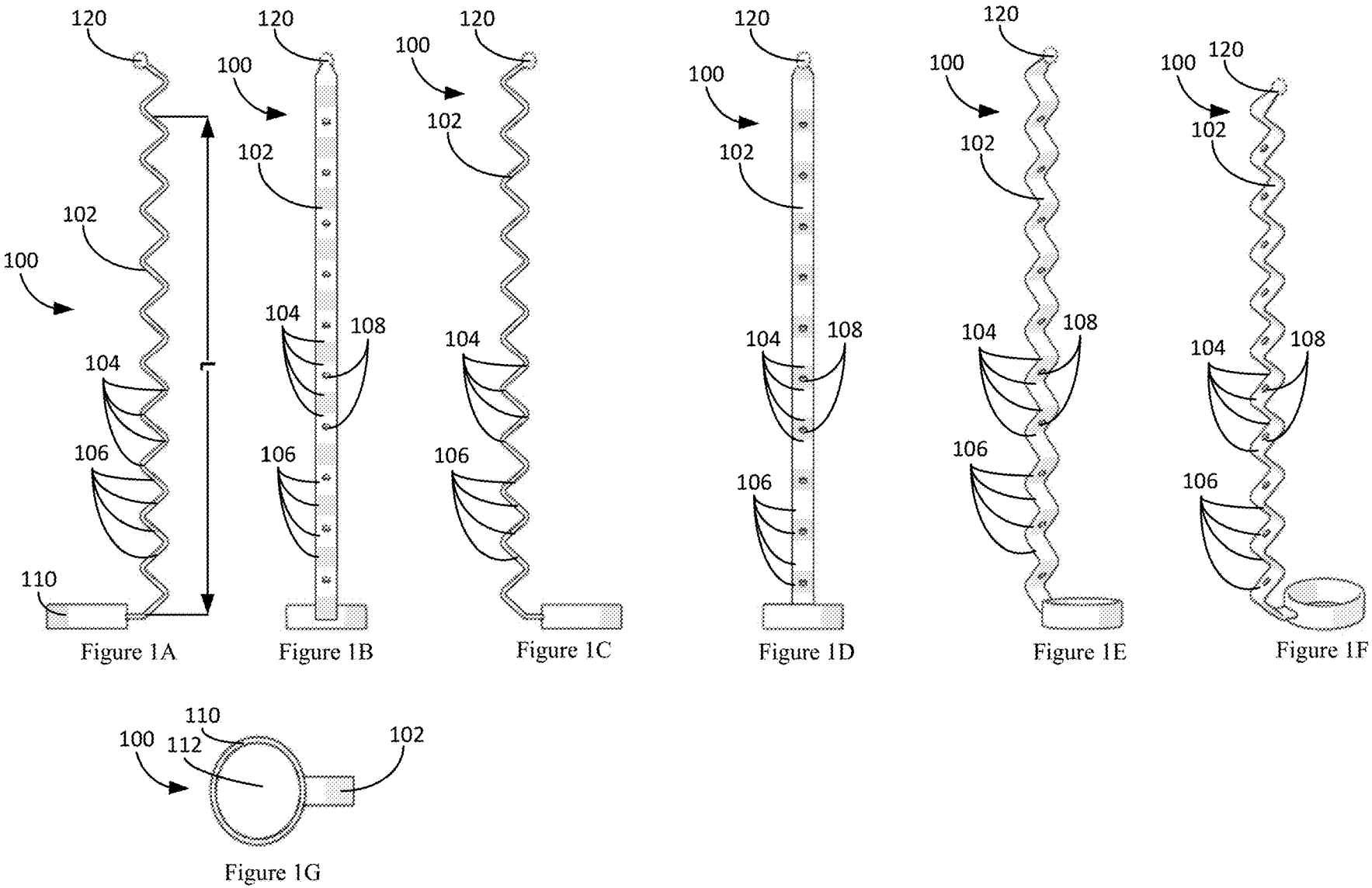
FIGS. 1A-1G illustrate various views of an embodiment of a bottle holder.

A bottle holder that includes a grip loop, an anchor arm, and a rigid member is described. The bottle holder is designed to hold a bottle (e.g., a baby bottle) via a flexible grip loop that stretches and tightens around the bottle to maintain secure attachment. The bottle holder is also designed to be tethered to a support structure to prevent misplacement of the bottle (e.g., dropping and/or losing the bottle) by positioning at least a portion of the anchor arm around a support object and inserting the rigid member through a snap aperture in the anchor arm. Advantageously, because the entire bottle holder is made of the same material that has certain elastic properties (e.g., elastic silicone), the bottle holder prevents a bottle full of liquid from dragging on the floor due to too much slack in the anchor arm, yet is still capable of stretching to allow freedom of movement with the bottle when a sufficient pulling force (e.g., a force greater than the weight of a full bottle of liquid) is applied.

FIGS. 1A-1G illustrate various views of an embodiment of a bottle holder. Referring to FIGS. 1A-1G, a bottle holder includes an anchor arm 102, a grip loop 110, and a rigid member 120. The anchor arm 102 includes a plurality of bends 104, a plurality of segments 106, and at least two snap apertures 108. Each segment 106 is positioned between two adjacent bends of the plurality of bends 104. Each bend 104 creates an angle (e.g., 90 degrees) between each segment of the plurality of segments 106 to create a back-and-forth pattern (e.g., a zig-zag pattern) for the anchor arm 102. In some cases, each segment of the plurality of segments 106 are an equal length.

The anchor arm 102 has an effective length L in a rested state due to the back-and-forth pattern. The effective length L of the anchor arm 102 can be substantially the same (e.g., within 10%) when supporting the weight of a bottle full of liquid due to the elastic properties of the material of the bottle holder 100. Advantageously, due to the back and forth pattern of the elastic material, when a sufficient pulling force (e.g., a force greater than the weight of a full bottle of liquid) is applied, the plurality of bends 104 can deform (e.g., create an angle greater than 90 degrees) between each segment of the plurality of segments 106 to extend the effective length L of the anchor arm 102 in the rested state to a greater length (e.g., >L). This allows a person to simply let go of the bottle without fear that the bottle will be lost or dragged on the ground during movement. This is especially advantageous to parents with a baby. Indeed, a baby can drop the bottle at any point and the parents do not need to fear that the bottle will be lost, damaged, and/or become unsanitary due to contact with the ground. Furthermore, a parent can still pick up their baby with the bottle, extending the anchor arm 102 without the parent having to detach the bottle from the bottle holder 100.

The grip loop 110 is disposed at a proximal end of the anchor arm 102 and forms a bottle aperture 112 for holding a bottle. Similar to the snap aperture 108, which is described in more detail below, a bottle can have a radial circumference that is larger than a radial circumference of the bottle aperture 112 formed by the grip loop 110. However, due to the elastic properties of the material, the grip loop 110 stretches and tightens around the bottle to maintain secure attachment. In other words, the grip loop 110 may have an initial radial circumference that is smaller than a radial circumference of a bottle; however, due to the properties of the material that the bottle holder 100 (including the grip loop 110) is made of, the radial circumference of the grip loop 110 can be deformed to expand to fit around the radial circumference of the bottle. In some cases, the grip loop 110 can have a specific width and thickness (e.g., of the material itself) to securely hold the bottle.

The rigid member 120 is disposed at a distal end of the anchor arm 102. Each snap aperture 108 of the at least two segments of the plurality of segments 106 of the anchor arm 102 is configured to receive the rigid member 120. For example, the rigid member 120 may have a radial circumference that is larger than each snap aperture 108. However, due to the elastic properties of the material that the bottle holder 100 is made of, the material around each snap aperture 108 can stretch/deform to allow the rigid member 120 to pass through the snap aperture 108, and then tighten back up to the snap aperture's original size (or as close to its original size as the material that attaches the anchor arm 102 to the rigid member 120 allows). In other words, the rigid member 120 and a snap aperture(s) 108 provide a "snap-fit" functionality. In some cases, the rigid member 120 may have a flat edge formed at a distal end of the anchor arm 102; and the shape of the distal end of the rigid member 120 may be smoothed/rounded, so that it is easier (e.g., requires less force) to insert the rigid member 120 through a snap aperture 108 than it is to remove the rigid member 120 from the snap aperture 108.

In some cases, the rigid member the rigid member 120 is made of the exact same material as the rest of the bottle holder 100. In some of these cases, the material that the rigid member 120 is made of is less porous (e.g., has less air within the material; is more dense). In some of these cases, the thickness of the material that the rigid member 120 is made of is thicker than the rest of the bottle holder 100 (e.g., thicker than the material of the anchor arm 102 and/or the grip loop 110). It should be understood that the rigid member 120 may not be completely rigid, and may even merely be a specific shape that does not allow the rigid member 120 to be pulled from the snap aperture with a force that is less than, equal to, or slightly above (e.g., less than 1.5 times) the weight of a bottle full of liquid (e.g., square peg/round hole).

In some cases, the rigid member 120 may have a different material within (e.g., at its core), such as a non-compliant material. In these cases, the elastic material that the rest of the bottle holder 100 is made of surrounds the different material so that all exposed surfaces of the rigid member 120 are made of the elastic material. In some cases, the elastic material that the bottle holder 100 is made of (e.g., including or not including the core of the rigid member 120) is silicone, rubber silicone, polypropylene and/or any other plastic-type material that provides sufficient elasticity and is also child-safe (e.g., has no additives that are known to be harmful to children/infants). The material of the bottle holder 100 may be any color and may have ornamental illustrations on its surface.

Specific dimensions of the anchor arm 102, the grip loop 110, and the rigid member 120 may vary. As a specific example, the grip loop 110 may have a height of 15 millimeters, a thickness of 56 millimeters, and an inner diameter/radial circumference capable of stretching from 50 millimeters to 100 millimeters (and contracting back to 50 millimeters). The anchor arm 102 may have 21 bends 104 forming 90° angles between 21 segments 106, the plurality of segments 106 each having 18 millimeters in length, a uniform thickness of 3 millimeters, and every other segment having a snap aperture 108 of 4 millimeters in radial circumference. More or fewer segments may be provided. In addition, the snap apertures may be disposed in more or fewer segments and in any suitable pattern. The rigid member 120 may have a radial circumference of 5 millimeters. In some cases, as explained in more detail below, a second rigid member and/or a rod may be included. In some cases, the second rigid member may have a radial circumference of 5 millimeters; in some cases, the second rigid member may have a radial circumference of 10 millimeters. In some cases, the rod may have a radial circumference of 3 millimeters and a length of 20 millimeters.

Figure 2:
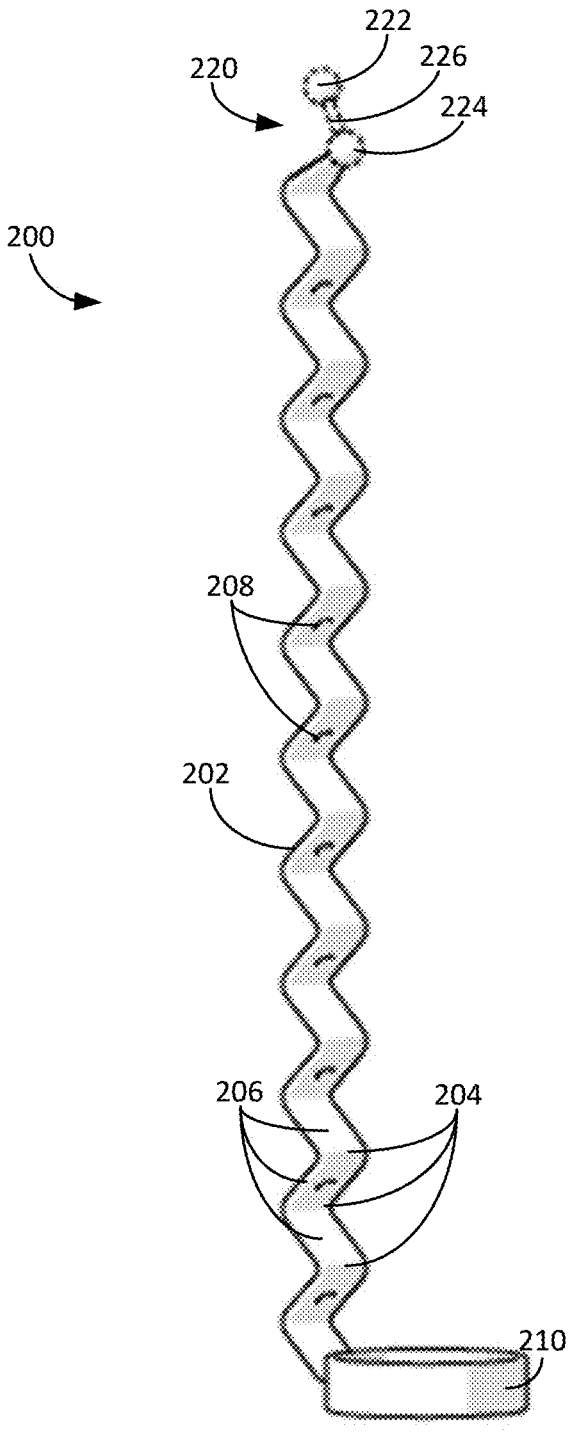
FIG. 2 illustrates a side angled view of an embodiment of a bottle holder.

FIG. 2 illustrates a side angled view of an embodiment of a bottle holder. Referring to FIG. 2, a bottle holder 200 includes an anchor arm 202, a grip loop 210, and a rigid end 220. Similar to the embodiment illustrated in FIGS. 1A-1G, the anchor arm 202 includes a plurality of bends 204, a plurality of segments 206, and at least two snap apertures 208; the grip loop 210 is disposed at a proximal end of the anchor arm 202 and forms a bottle aperture (not shown in this figure) for holding a bottle; and the rigid end 220 is disposed at a distal end of the anchor arm 202. However, in this embodiment, the rigid end 220 includes a first rigid member 222, a second rigid member 224 disposed between the distal end of the anchor arm 202 and the first rigid member 222, and a rod 226 disposed between the first rigid member 222 and the second rigid member 224. In some cases, both the first rigid member 222 and the second rigid member 224 have a radial circumference that is larger than each snap aperture 208. In some cases, the rod 226 has a radial circumference that is smaller than each snap aperture 208. In some cases, the second rigid member 224 has a flat edge formed at a distal end of the second rigid member 224 itself. In some cases, the second rigid member 224 is larger than the first rigid member 222, such that the first rigid member 222 may pass through a snap aperture 208 while the second rigid member 224 cannot pass through the snap aperture 208 (e.g., leaving the snap aperture 208 around the rod 226 between the first and second rigid member 222, 224). In some cases, the rigid end 220 may include the rod 226 and not the second rigid member 224.

Figure 3:
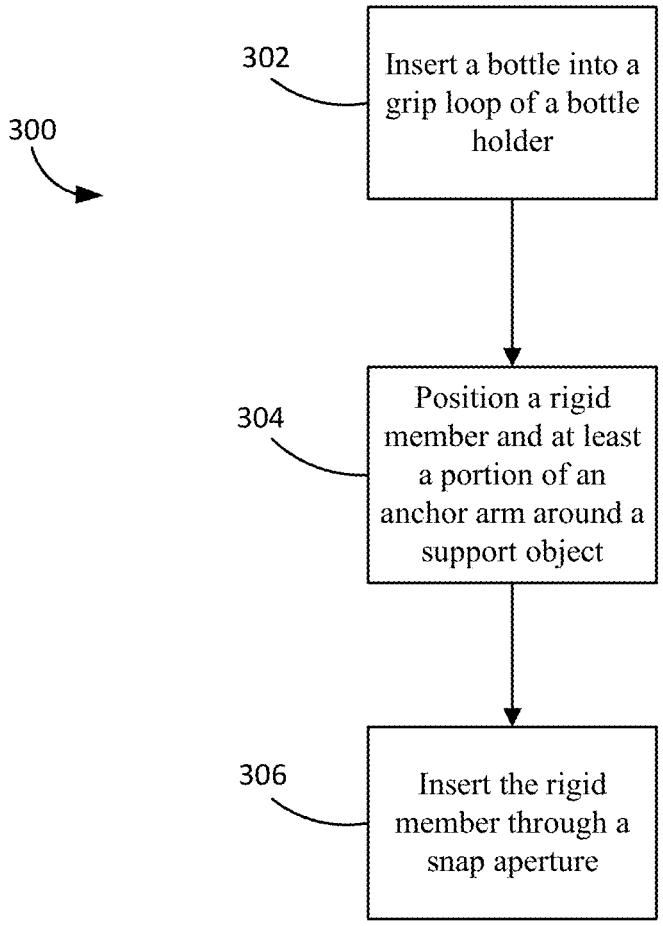
FIG. 3 illustrates an example method of using a bottle holder.

FIG. 3 illustrates an example method of using a bottle holder. Referring to FIG. 3, the method 300 includes inserting (302) a bottle into a grip loop of the bottle holder, positioning (304) a rigid member and at least a portion of the anchor arm around a support object, and inserting (306) the rigid member through one snap aperture of the at least two segments of the plurality of segments of the anchor arm.

Figure 4A:
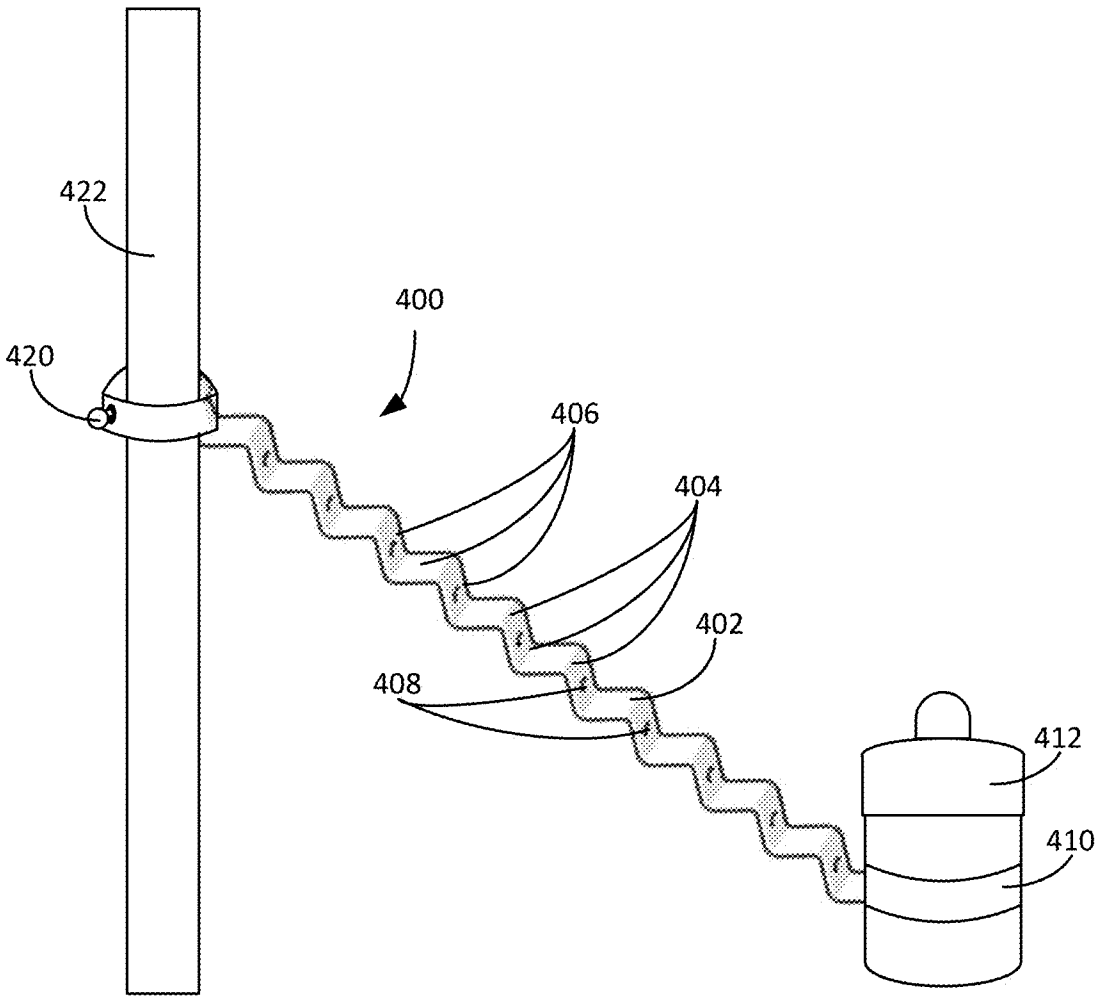
FIGS. 4A-4C illustrate the use of a bottle holder.
Figure 4B:
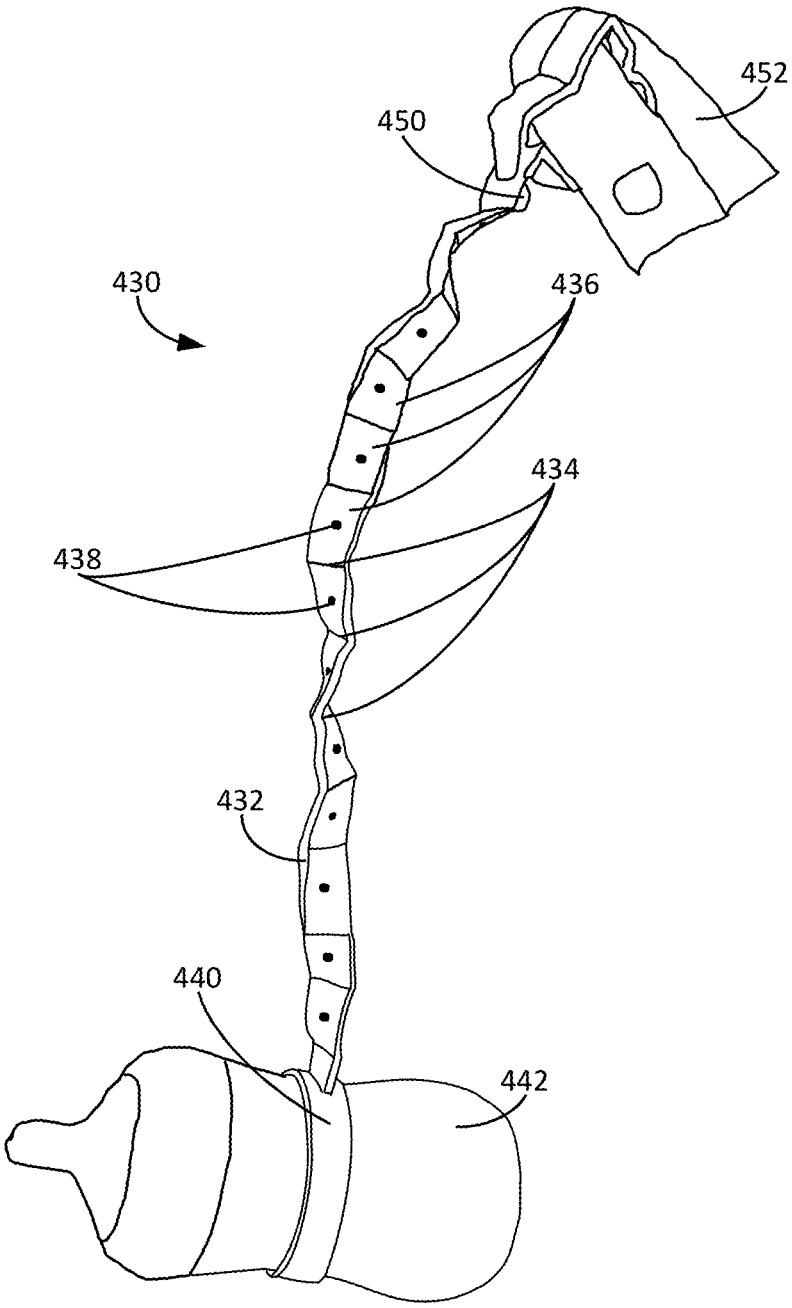
Figure 4C:
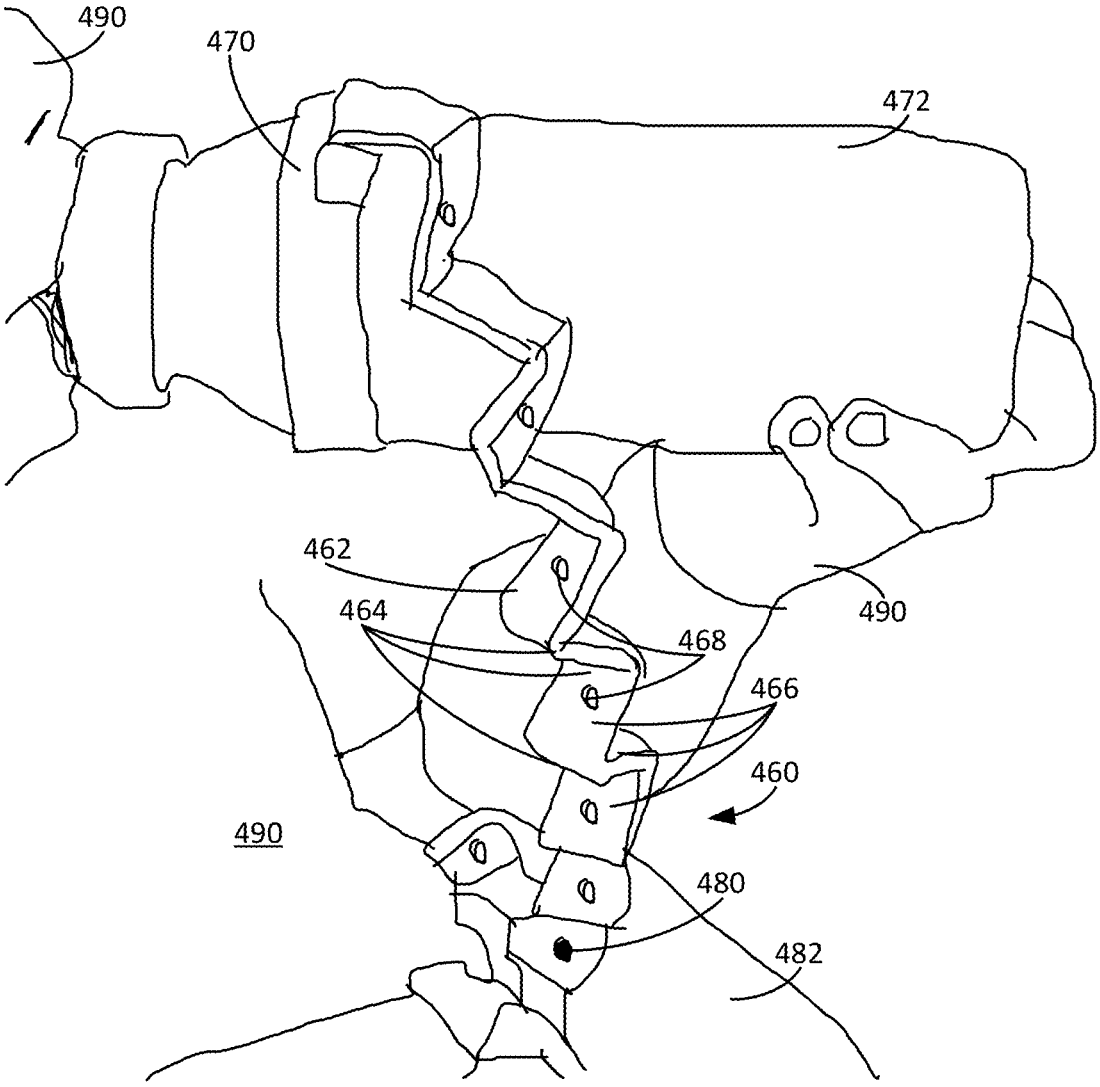

FIGS. 4A-4C illustrate the use of a bottle holder. Referring to FIG. 4A, the bottle holder 400 has been attached to a support object 422 (e.g., a pole) and a bottle 412. Specifically, the bottle 412 has been inserted into a grip loop 410 of the bottle holder 400, a rigid member 420 and a portion of the anchor arm 402 have been positioned around the support object 422, and the rigid member 420 has been inserted through a snap aperture 408 of the plurality of segments 406 of the anchor arm 402. Furthermore, due to the plurality of bends 404, an effective length L of the anchor arm 402 can be substantially the same (e.g., within 10%) when supporting the weight of a bottle full of liquid due to the elastic properties of the material of the bottle holder 400, yet extended (e.g., >L) when a sufficient pulling force (e.g., a force greater than the weight of a full bottle of liquid) is applied, deforming the plurality of bends 404 (e.g., create an obtuse angle) between each segment of the plurality of segments 406.

Referring to FIG. 4B, the bottle holder 430 has been attached to a support object 452 (e.g., a handle) and a bottle 442. Specifically, the bottle 442 has been inserted into a grip loop 440 of the bottle holder 430, a rigid member 450 and a portion of the anchor arm 432 have been positioned around the support object 452, and the rigid member 450 has been inserted through a snap aperture 438 of the plurality of segments 436 of the anchor arm 432. Furthermore, due to the plurality of bends 434, an effective length L of the anchor arm 432 can be substantially the same (e.g., within 10%) when supporting the weight of a bottle full of liquid due to the elastic properties of the material of the bottle holder 430, yet extended (e.g., >L) when a sufficient pulling force (e.g., a force greater than the weight of a full bottle of liquid) is applied, deforming the plurality of bends 434 (e.g., create an obtuse angle) between each segment of the plurality of segments 436 allowing for a greater range of movement with the bottle than current bottle holders.

Referring to FIG. 4C, the bottle holder 460 has been attached to a support object 482 (e.g., a baby stroller) and a bottle 472. Specifically, the bottle 472 has been inserted into a grip loop 470 of the bottle holder 460, a rigid member 480 and a portion of the anchor arm 462 have been positioned around the support object 482, and the rigid member 480 has been inserted through a snap aperture 468 of the plurality of segments 466 of the anchor arm 462. Furthermore, due to the plurality of bends 464, an effective length L of the anchor arm 432 can be substantially the same (e.g., within 10%) when supporting the weight of a bottle full of liquid due to the elastic properties of the material of the bottle holder 460, yet extended (e.g., >L) when a sufficient pulling force (e.g., a force greater than the weight of a full bottle of liquid) is applied, deforming the plurality of bends 464 (e.g., create an obtuse angle) between each segment of the plurality of segments 466. This allows the infant 490 to simply let go of the bottle 472, and the infant's parent(s) do not need to fear that the bottle 472 will be lost, damaged, and/or become unsanitary due to contact with the ground. Furthermore, the infant's parent(s) can still pick up the infant 490 with the bottle 472, extending the anchor arm 102 without the parent having to detach the bottle from the bottle holder 100/bottle holder 460.

Indeed, in addition to a baby stroller, a bottle holder may be attached to any support object that a person would like to secure a bottle to, including but not limited to, a high chair, a car seat, a piece of exercise equipment, a bicycle, and the like.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A bottle holder, comprising:

an anchor arm comprising a plurality of bends and a plurality of segments, wherein a segment is a portion of the anchor arm between two adjacent bends of the plurality of bends, wherein at least two segments of the plurality of segments of the anchor arm each comprise an opening such that the segment to which the opening belongs forms a snap aperture;

a grip loop forming a bottle aperture for holding a bottle disposed at a proximal end of the anchor arm; and a rigid member disposed at a distal end of the anchor arm, wherein each snap aperture of the at least two segments of the plurality of segments of the anchor arm is configured to receive the rigid member through the opening of that segment.

2. The bottle holder of claim 1, wherein the rigid member has a radial circumference that is larger than each snap aperture of the at least two segments of the plurality of segments of the anchor arm.

3. The bottle holder of claim 2, wherein the rigid member has a flat edge formed at the distal end of the anchor arm.

4. The bottle holder of claim 2, further comprising:

a second rigid member disposed between the distal end of the anchor arm and the rigid member; and a rod disposed between the rigid member and the second rigid member.

5. The bottle holder of claim 4, wherein the second rigid member has a radial circumference that is larger than each snap aperture of the at least two segments of the plurality of segments of the anchor arm.

6. The bottle holder of claim 5, wherein the rod has a radial circumference that is smaller than each snap aperture of the at least two segments of the plurality of segments of the anchor arm.

7. The bottle holder of claim 6, wherein the second rigid member has a flat edge formed at a distal end of the second rigid member.

8. The bottle holder of claim 1, wherein each segment of the plurality of segments of the anchor arm are an equal length.

9. The bottle holder of claim 1, wherein the grip loop, the anchor arm, and the rigid member are made of a single piece of elastic silicon material.

10. The bottle holder of claim 1, wherein the grip loop has a width and thickness to securely hold the bottle.

11. A method of using a bottle holder comprising an anchor arm comprising a plurality of bends and a plurality of segments, wherein a segment is a portion of the anchor arm between two adjacent bends of the plurality of bends, wherein at least two segments of the plurality of segments of the anchor arm each comprise an opening such that the segment to which the opening belongs forms a snap aperture; a grip loop forming a bottle aperture for holding a bottle disposed at a proximal end of the anchor arm; and a rigid member disposed at a distal end of the anchor arm, wherein each snap aperture of the at least two segments of the plurality of segments of the anchor arm is configured to receive the rigid member through the opening of that segment the bottle holder of claim 1, the method comprising:

inserting the bottle into the grip loop;

positioning the rigid member and at least a portion of the anchor arm around a support object; and inserting the rigid member through one snap aperture of the at least two segments of the plurality of segments of the anchor arm.

12. The bottle holder of claim 1, wherein the grip loop is a single continuous piece in a shape of a loop.

13. The bottle holder of claim 1, wherein the rigid member has a rounded shape.

* * * * *